US007571503B2

(12) United States Patent
Gabriel

(10) Patent No.: US 7,571,503 B2
(45) Date of Patent: Aug. 11, 2009

(54) HEADPHONE PILLOW

(75) Inventor: Tyronne Gerard Gabriel, Canoga Park, CA (US)

(73) Assignee: Metric Products, Inc., Culver City, CA (US)

( * ) Notice: Subject to any disclaimer, the term of this patent is extended or adjusted under 35 U.S.C. 154(b) by 287 days.

(21) Appl. No.: 11/229,181

(22) Filed: Sep. 15, 2005

(65) Prior Publication Data

US 2007/0056107 A1 Mar. 15, 2007

(51) Int. Cl.
*A47C 20/00* (2006.01)

(52) U.S. Cl. ..... 5/636; 5/639; 5/904; 5/640; 381/300; 381/301; 381/309; 381/388; 381/370

(58) Field of Classification Search ..... 5/621, 5/622, 656, 636, 639, 655, 637, 640, 643, 5/645; 381/309, 378, 300, 301, 388, 370; 455/344; 181/130
See application file for complete search history.

(56) References Cited

U.S. PATENT DOCUMENTS

| | | | | | |
|---|---|---|---|---|---|
| 2,958,769 | A | | 11/1960 | Bounds | |
| 3,290,450 | A | * | 12/1966 | Majoros | 381/182 |
| 3,384,719 | A | * | 5/1968 | Lanzara | 381/301 |
| 3,621,155 | A | | 11/1971 | Pruitt | |
| 3,792,754 | A | * | 2/1974 | Hanson | 181/130 |
| 3,902,120 | A | | 8/1975 | Dascal et al. | |
| 3,946,316 | A | | 3/1976 | Hough | |
| 4,038,499 | A | * | 7/1977 | Yeaple | 381/301 |
| 4,243,851 | A | | 1/1981 | Forney | |
| 4,440,443 | A | * | 4/1984 | Nordskog | 297/397 |
| 4,782,533 | A | | 11/1988 | Haynie | |
| 4,797,934 | A | * | 1/1989 | Hufnagel | 381/388 |
| 4,862,438 | A | | 8/1989 | Fry | |
| 4,864,619 | A | | 9/1989 | Spates | |
| 4,991,222 | A | | 2/1991 | Nixdorf | |
| 5,123,133 | A | | 6/1992 | Albert | |
| 5,313,678 | A | * | 5/1994 | Redewill | 5/639 |
| 5,357,642 | A | | 10/1994 | Clute | |
| 5,370,446 | A | * | 12/1994 | Bancod | 297/408 |
| 5,479,667 | A | | 1/1996 | Nelson et al. | |
| 5,813,065 | A | * | 9/1998 | Tinhorn | 5/639 |
| 5,819,346 | A | * | 10/1998 | Lane | 5/639 |

(Continued)

FOREIGN PATENT DOCUMENTS

| | | |
|---|---|---|
| CA | 2156541 | 2/1997 |

*Primary Examiner*—Victor Batson
*Assistant Examiner*—Emily M Morgan
(74) *Attorney, Agent, or Firm*—Blakely, Sokoloff, Taylor & Zafman LLP

(57) ABSTRACT

A headphone pillow includes a support portion. The support portion is flexible and has a first end and a second end. A first pillow portion has a first pillow ear portion connected to the first end of the support portion. The first pillow portion has a first pillow receive portion. A second pillow portion has a second pillow ear portion connected to the second end of the support portion. The second pillow portion has a second pillow receive portion. The first pillow portion and the second pillow portion each have a release mechanism. The first pillow ear portion and the second pillow ear portion each have a first side and a second side. The second side of either the first pillow ear portion or the second pillow ear portion is independently removably connected to either the first pillow receive portion or the second pillow receive portion.

4 Claims, 3 Drawing Sheets

U.S. PATENT DOCUMENTS

| | | | | |
|---|---|---|---|---|
| 6,098,220 | A | 8/2000 | Momma | |
| 6,668,407 | B1 | 12/2003 | Reitzel | |
| 6,744,898 | B1 * | 6/2004 | Hirano | 381/333 |
| 6,893,094 | B2 * | 5/2005 | O'Connor | 297/397 |
| 7,162,048 | B2 * | 1/2007 | Shima | 381/334 |
| 7,283,641 | B2 * | 10/2007 | Rolla | 381/376 |
| 2001/0054837 | A1 * | 12/2001 | O'Connor | 297/397 |
| 2003/0139693 | A1 * | 7/2003 | Swift | 601/15 |
| 2003/0234567 | A1 * | 12/2003 | O'Connor | 297/391 |
| 2005/0053255 | A1 * | 3/2005 | Harris et al. | 381/379 |
| 2005/0179300 | A1 * | 8/2005 | O'Connor et al. | 297/391 |
| 2005/0190935 | A1 * | 9/2005 | Sakamoto | 381/302 |

* cited by examiner

HEADPHONE PILLOW

BACKGROUND

1. Field

The embodiments relate to headphone pillows, and more particularly to a wrap-around pillow having repositional headphones.

2. Description of the Related Art

There are many types of headphones that serve the purpose of comfort, relaxation and enjoyment. Headphones can be used in many places and for many reasons. The existing headphones, however, have some limitations. One type of headphone pillow exists where a user must lie down on the pillow and fixed positioned speakers are built into the pillow. Others must remain on a user's ears at all times, as the speakers are immovable. Other types of headphones include speakers that are placed in the ear canal. These, however, can lead to irritation and soreness if left in an ear for a long time, e.g. a full-length movie.

SUMMARY

One embodiment includes a headphone pillow having a support portion. The support portion is flexible and has a first end and a second end. A first pillow portion has a first pillow ear portion connected to the first end of the support portion. The first pillow portion has a first pillow receive portion. A second pillow portion has a second pillow ear portion connected to the second end of the support portion. The second pillow portion has a second pillow receive portion. The first pillow portion and the second pillow portion each have a release mechanism. The first pillow ear portion and the second pillow ear portion each have a first side and a second side. The second side of either the first pillow ear portion or the second pillow ear portion is independently removably connected to either the first pillow receive portion or the second pillow receive portion.

Another embodiment includes a headphone including a flexible support. The flexible support is curved. A first pillow portion has a first pillow ear portion connected to a first portion of the flexible support. The first pillow portion has a first pillow receive portion. A second pillow portion has a second pillow ear portion connected to a second portion of the flexible support. The second pillow portion has a second pillow receive portion. A third pillow portion is connected to a third portion of the flexible support. The first pillow ear portion and the second pillow ear portion each have a first side and a second side. The second side is independently removably connected to either of the first pillow receive portion and the second pillow receive portion.

Still another embodiment includes applying a force to a headphone pillow to force the headphone pillow from a first shape to a second shape, and removing the force applied to the headphone pillow. The headphone pillow returns to the first shape when the force is removed from the headphone pillow.

BRIEF DESCRIPTION OF THE DRAWINGS

The embodiments discussed herein generally relate to a headphone pillow with repositional headphones. Referring to the figures, exemplary embodiments will now be described. The exemplary embodiments are provided to illustrate the embodiments and should not be construed as limiting the scope of the embodiments.

DETAILED DESCRIPTION OF THE INVENTION

The invention generally relates to headphone pillows with repositional headphones. Referring to the figures, exemplary embodiments of the invention will now be described. The exemplary embodiments are provided to illustrate the invention and should not be construed as limiting the scope of the invention.

Figure 1:
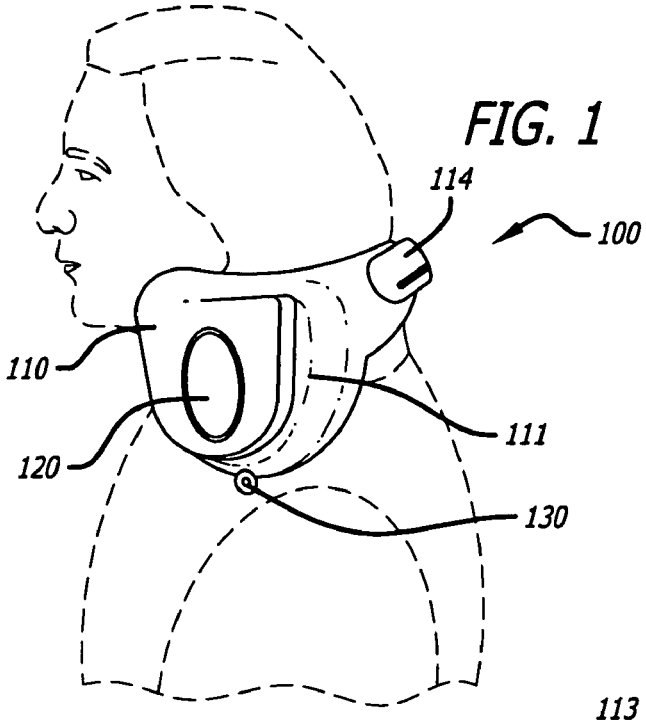
FIG. 1 illustrates a side view of an embodiment of the invention illustrated on a person's neck with the left headphone illustrated in a dosed state.

FIG. 1 illustrates headphone pillow 100 shown with first pillow ear portion 110 shown in a closed position. Headphone pillow 100 includes support portion 210 having an inner member (see FIG. 2) that is flexible and curved and has a first end and a second end first pillow portion 111 having first pillow ear portion 110 connected to the first end of support portion 210. In one embodiment third pillow portion 114 is connected to a third portion of support portion 210. In one embodiment the inner member of support portion 210 is made of a flexible plastic polymer, a metal, a metal alloy, etc.

Figure 4:
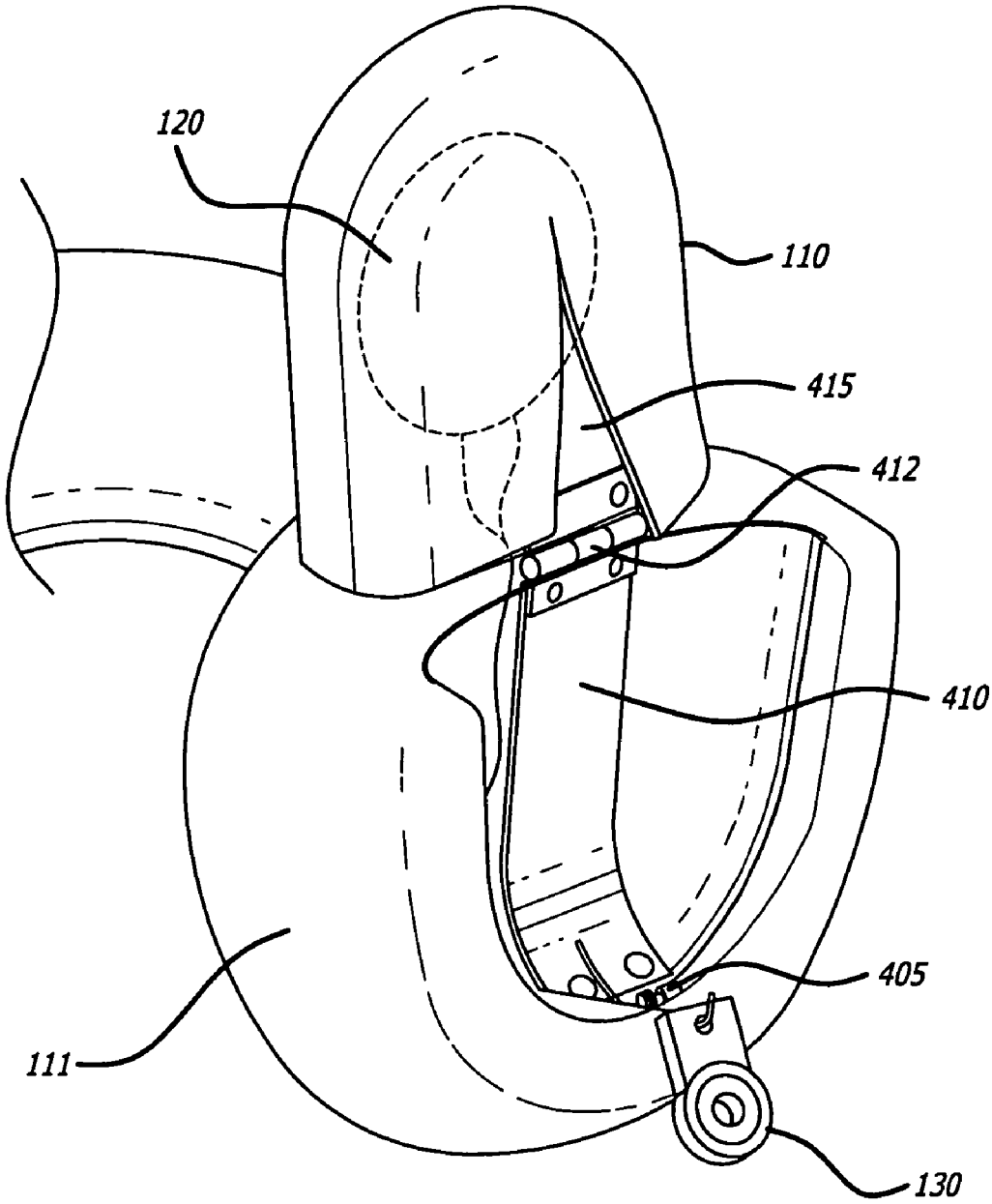
FIG. 4 illustrates the embodiment illustrated in FIG. 1 with the left headphone illustrated in an opened state showing the internal lock and release mechanism.

First pillow portion 111 has first pillow receive portion 405 (see FIG. 4). Headphone pillow 100 also includes second pillow portion 112 having second pillow ear portion 113 that is connected to the second end of support portion 210. Second pillow portion 112 includes a second pillow receive portion (not illustrated) that is the same as first pillow receive portion 405, but on the second pillow portion 112.

In one embodiment first pillow portion 111 and second pillow portion 112 each have release mechanism 130. First pillow ear portion 111 and second pillow ear portion 112 each has a first side and a second side, and the second side is independently removably connected to either first pillow receive portion 405 and the second pillow receive portion.

In one embodiment headphone pillow 100 is covered in soft material, such as cotton blends, synthetic material (e.g., polyester), neoprene, compressible material, such as a foam polymer type material, velour, terry, etc. In one embodiment, headphone pillow 100 is made of a polymer foam material that is layered and has shape memory. In this embodiment, headphone pillow 100 can be forced into different shapes and into a compressed size. When the force is removed, headphone pillow 100 returns to its original shape and size. In other embodiments, headphone pillow 100 includes filling material. In this embodiment, the filling material can be natural or synthetic. In one embodiment, the filling material can be polystyrene beads, millet seed/hulls, buckwheat seeds/hulls, etc.

Figure 2:
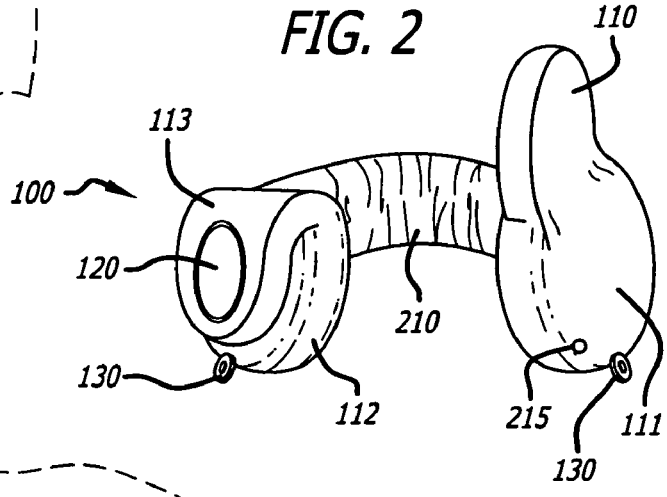
FIG. 2 illustrates a front view of the embodiment illustrated in FIG. 1 with one headphone repositioned from a closed state.

In one embodiment headphone pillow 100 includes plug 215 (see FIG. 2). Plug 215 receives a cord to connect to a sound source, such as a radio, a stereo system, an airplane entertainment system, a personal entertainment device (e.g., MP3 player, compact disk player, notebook computer, etc.). In another embodiment, headphone pillow 100 includes a cord to plug into the above-mentioned sound sources.

Figure 5:
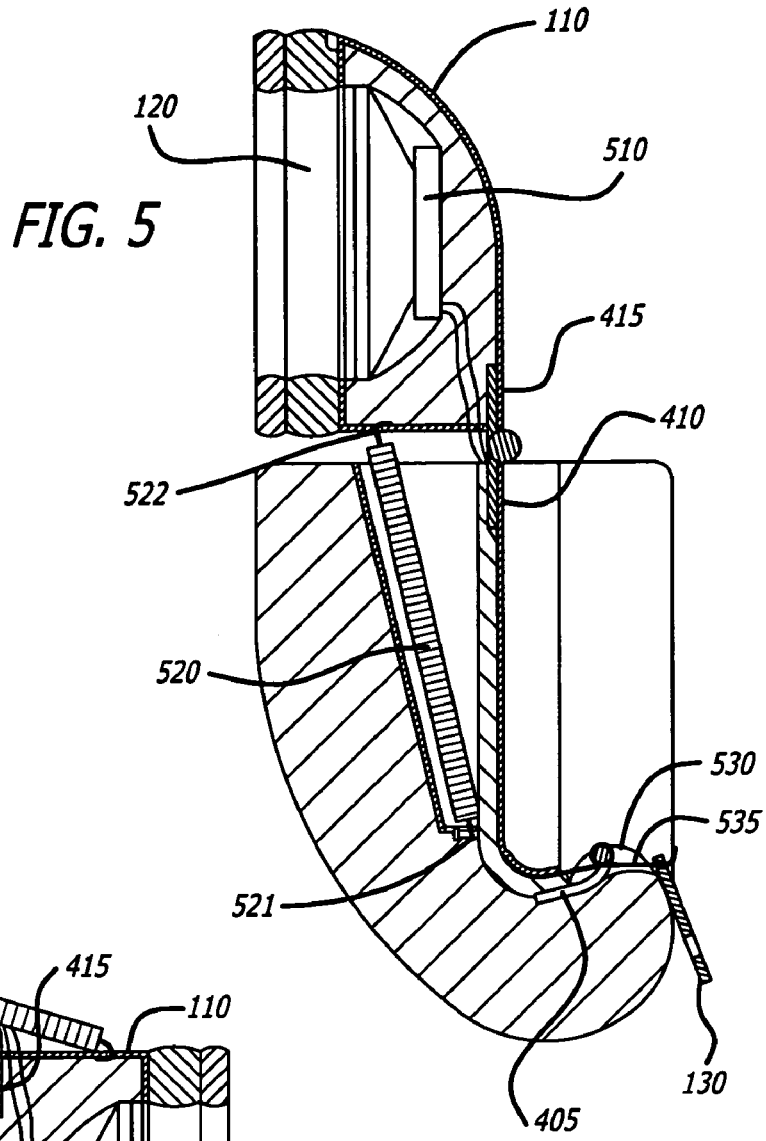
FIG. 5 illustrates a cut-through view of a headphone shown in the opened position.

In one embodiment headphone pillow 100 includes earpiece 120 including a headphone speaker 510 (see FIG. 5)

that is connected to first pillow ear portion 110 and second pillow ear portion 113. In this embodiment earpiece 120 including speaker 510 emits sound waves to a user. It should be noted that typical headphone speakers can be used with the above described embodiments. Earpiece 120 has an inner depth that can be ½ inch, ¾ inch, 1 inch, etc. The inner depth of earpiece 120 allows a person's ear from being in direct contact with headphone speaker 510. In one embodiment earpiece 120 includes material and speaker 510 is a noise canceling speaker to cancel or substantially reduce ambient sound.

First pillow ear portion 110 and second pillow ear portion 113 with earpiece 120 have cushioning disposed between an outer portion and an inner portion to aid in comfort to a person's ear when positioned next to an ear and acts as additional pillow cushioning when folded in a closed position. The inner portion covers earpiece 120. In one embodiment the inner portion is a sound permeable material to protect speaker 510 from contacting a person's ear, dust, liquids, etc. In one embodiment earpiece 120 includes foam padding. In another embodiment, earpiece 120 includes a liquid or gel filled portion for cushioning. In yet another embodiment earpiece 120 includes a sealed air chamber. In another embodiment, ear piece 120 includes an air chamber that can be manually adjusted for the amount of air in the chamber.

FIG. 2 illustrates headphone pillow 100 shown with first pillow ear portion 110 in an open position that places earpiece portion 120 next to a person's ear for listening to sound waves or for canceling ambient noise. Second pillow ear portion 113 is illustrated in a closed position. When either of the pillow ear portions (110 and 113) is in the closed position, headphone pillow 100 can be worn/used as a pillow against a seat, chair, airplane chair, couch, car seat, train seat, bus seat, etc.

Figure 3:
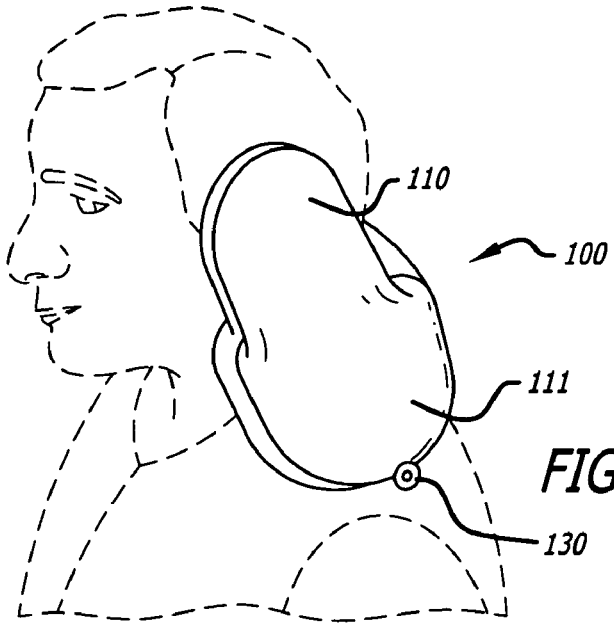
FIG. 3 illustrates the embodiment illustrated in FIG. 1 with the left headphone illustrated in an opened state.

FIG. 3 illustrates headphone pillow 100 shown with first pillow ear portion 110 in the open position. As illustrated, first pillow ear portion 110 is positioned next to a person's ear. In the open position, headphone pillow 100 is used as a pillow and for listening to sound waves and/or for canceling/reducing ambient sound/noise. Headphone pillow 100 is comfortable to wear by a person and does not have to be strapped over the top of a person's head or have a small speaker placed in a person's ear, which can cause discomfort or irritation after remaining in an ear for a long time period.

FIG. 4 illustrates first pillow portion 111 illustrated with first pillow ear portion 110 in an open position showing internal components for locking and releasing first pillow ear portion 110. In one embodiment headphone pillow 100 includes first hinge portion 415 connected to first pillow ear portion 110 and second hinge portion 410 connected to first pillow portion 111. Spring portion 412 is connected between first hinge portion 415 and second hinge portion 410. Spring portion 412 forces first pillow ear portion 110 to an open position when locking portion 405 is forced away from a locking connector on first pillow ear portion 110 by a release mechanism. In one embodiment the release mechanism includes release tab 130 connected to a wire that is connected to locking portion 405. When release tab 130 is pulled the wire pulls locking portion away from the locking connector and first hinge portion 415 is forced away from second hinge portion 410 by energy stored in spring portion 412. In another embodiment, first pillow ear portion has a locking device, such as a snap, hook and loop fastener, etc., which connects to a complimentary device on first pillow portion 111. In this embodiment, the release and lock mechanism is manually operated by a person. It should be noted that other embodiments use known locking/releasing mechanisms, such as a push-button release, clothing snap lock, hook and loop fastener lock, etc.

Figure 6:
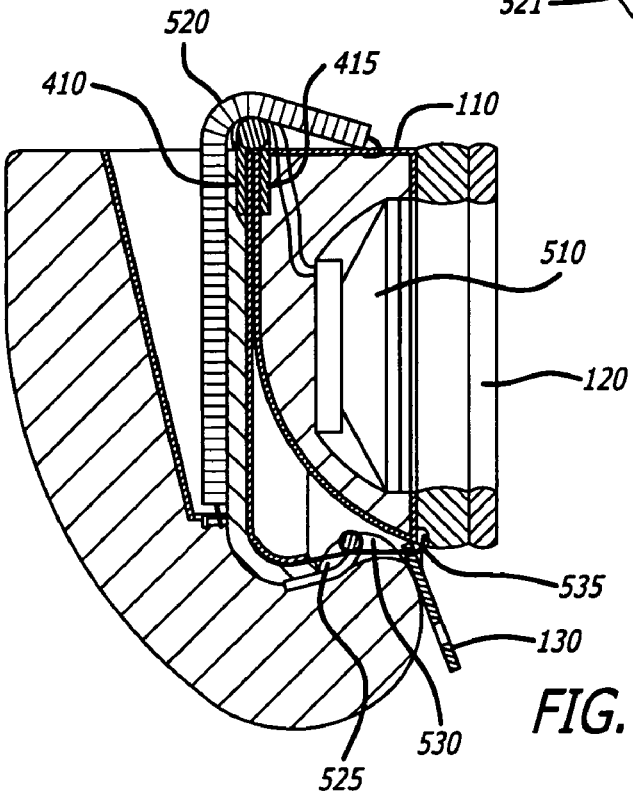
FIG. 6 illustrates a cut-through view of a headphone shown in the closed position.

FIG. 5 illustrates a side cut out view of an embodiment showing means for locking and means for releasing first and second pillow ear portions. As illustrated, first pillow ear portion 110 is in an open position. In this embodiment, spring 520 is coupled to first pillow ear portion 110 at first connecting portion 522, and second connecting portion 521. In this embodiment when release tab 130 is pulled away from first pillow portion 111, wire 535 pulls locking portion 405 away from locking groove 530, releasing first pillow ear portion from a locked/closed state. Spring 520, which is under tension when first pillow ear portion is in a closed state, returns to a state of less tension, which forces first pillow ear portion 110 into the open state/position. FIG. 6 illustrates the embodiment in FIG. 5 in a closed state/position.

One embodiment includes a method of applying a force to headphone pillow 100 to force headphone pillow 100 from a first shape, such as its original shape, to a second shape that is different from its original shape (e.g., compressing, squeezing, etc.). When the force is removed headphone pillow 100 returns to the first shape. The method further includes moving first pillow ear portion 111 from an open position to a locked position. When release tab 130 is pulled, first pillow ear portion returns to the open position.

The method further including storing headphone pillow 100 that is forced into the second shape in a space smaller than headphone pillow 100 can fit when in the first shape.

In one embodiment the composition of the material covering headphone pillow 100 is such that it can be formed by a heat source in a press which molds composite materials. Since this embodiment of headphone pillow 100 is comprised of molded material, headphone pillow 100 has shape "memory." Therefore, headphone pillow 100 can be folded, twisted, washed, etc., and will retain its original formed shape. In another embodiment headphone pillow 100 is formed from one contiguous molded material formed by heat and pressure applied to the material. Since headphone pillow 100 can be forced into various shapes and sizes, headphone pillow 100 is easily stowed when traveling on a vehicle, such as an airplane, a ship or boat, a bus or car, a motorcycle, a train, etc. It should be noted that when headphone pillow 100 is placed under a force, such as a persons hands clasping or squishing headphone pillow 100, air is removed from the foam polymer layer. This reduces the volume of the foam polymer allowing headphone pillow 100 to displace less volume. When the force is removed, air fills spaces in the foam polymer returning headphone pillow 100 back to its original displacement and original shape.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A headphone pillow comprising:

a curved support portion configured to at least partially encircle a back portion of a human neck, the support portion curved in a plane and concave in a forward longitudinal direction;

a first pillow portion coupled to a first end of the support portion;

a second pillow portion coupled to a second end of the support portion;

a first ear portion pivotally coupled to the first pillow portion on a first longitudinal axis substantially parallel to the plane of the support portion, the first ear portion including a first headphone speaker;

a second ear portion pivotally coupled to the second pillow portion on a second longitudinal axis substantially parallel to the plane of the support portion, the second ear portion including a second headphone speaker;

wherein each of the first and second pillow portions includes an outwardly facing cavity configured to at least partially receive a respective ear portion; and wherein the headphone pillow is configured to be worn about a user's neck with the first and second pillow portions positioned below the user's ears and wherein the first and second ear portions are each positionable about their respective longitudinal axes between a closed position within the cavity of a respective pillow portion and an open position proximate to a respective user's ear.

2. The headphone pillow of claim 1 further comprising first and second spring portions biasing the respective ear portions toward the open position.

3. The headphone pillow of claim 2 further comprising first and second release mechanisms coupled to the respective pillow portions and engaging the respective ear portions in the closed position, the release mechanisms operable to release the respective ear portions from the closed position.

4. The headphone pillow of claim 1 wherein each of the first and second ear portions includes cushioning on a side facing toward a user's head in the open position.

* * * * *